US008596633B2

(12) United States Patent
Awaya et al.

(10) Patent No.: US 8,596,633 B2
(45) Date of Patent: Dec. 3, 2013

(54) SHEET PROCESSING APPARATUS AND IMAGE FORMING APPARATUS

(71) Applicant: Canon Kabushiki Kaisha, Tokyo (JP)

(72) Inventors: Tetsuro Awaya, Tokyo (JP); Hiroshi Ota, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/678,690

(22) Filed: Nov. 16, 2012

(65) Prior Publication Data

US 2013/0069298 A1 Mar. 21, 2013

Related U.S. Application Data

(62) Division of application No. 12/787,793, filed on May 26, 2010, now Pat. No. 8,333,372.

(30) Foreign Application Priority Data

Jun. 5, 2009 (JP) ..... 2009-135660
May 18, 2010 (JP) ..... 2010-114384

(51) Int. Cl.
*B65H 37/04* (2006.01)

(52) U.S. Cl.
USPC ..... 270/58.08; 270/58.07; 270/58.09

(58) Field of Classification Search
USPC ..... 270/58.07, 58.08, 58.09
See application file for complete search history.

(56) References Cited

U.S. PATENT DOCUMENTS

| | | | |
|---|---|---|---|
| 6,276,677 | B1 | 8/2001 | Hommochi et al. |
| 6,905,118 | B2 | 6/2005 | Yamada et al. |
| 7,020,411 | B2 | 3/2006 | Awaya |
| 7,300,044 | B2 | 11/2007 | Stemmle |
| 7,744,073 | B2 | 6/2010 | Iguchi et al. |
| 2006/0190125 | A1 | 8/2006 | Stemmle |
| 2008/0315488 | A1 | 12/2008 | Iguchi et al. |

FOREIGN PATENT DOCUMENTS

| | | | |
|---|---|---|---|
| JP | 6-72060 | | 3/1994 |
| JP | 7-089256 | A | 4/1995 |
| JP | 2003-182928 | | 7/2003 |
| JP | 2004-294616 | A | 10/2004 |
| JP | 2009-51661 | | 3/2009 |
| WO | 2009/110298 | A1 | 9/2009 |

*Primary Examiner* — Leslie A Nicholson, III
(74) *Attorney, Agent, or Firm* — Fitzpatrick, Cella, Harper & Scinto

(57) ABSTRACT

A sheet processing apparatus that forms asperity on a sheet bundle so as to bind the sheet bundle, has a pair of rotating members having a concave and convex portions on the outer periphery, a moving portion that moves at least one of the pair of the rotating members so as to nip the sheet bundle by the pair of the rotating members or release the sheet bundle, and a controlling portion that controls the moving portion to allow the pair of rotating members to rotate with a concave portion of one rotating member and a convex portion of the other meshed with each other while nipping the sheet bundle or releasing the sheet bundle.

16 Claims, 19 Drawing Sheets

SHEET PROCESSING APPARATUS AND IMAGE FORMING APPARATUS

This application is a divisional of U.S. patent application Ser. No. 12/787,793, filed May 26, 2010, and allowed on Aug. 21, 2012.

BACKGROUND OF THE INVENTION

1. Field of the Invention

The present invention relates to a sheet processing apparatus that binds a sheet bundle including a plurality of sheets, and an image forming apparatus provided with the sheet processing apparatus.

2. Description of the Related Art

In recent years, there has been increasing a demand for a process of binding sheets, having an image recorded thereon by an image forming apparatus such as a copying machine or a printer, into a booklet form as a conference material or a distributed material. As a sheet processing apparatus that meets the demand described above, there has conventionally widely been used a staple apparatus that binds a sheet bundle, including plural sheets, with a binding member such as a metal needle.

On the other hand, recycling a used sheet has attracted attention in recent years from the viewpoint of environmental protection. In order to recycle the sheet, the sheet bundle bound with the metal needle has to be collected in such a manner that the metal needle is removed from the sheet, and the sheet and the metal needle are separated, which is a troublesome task. The sheet can be reused, but the metal needle is dumped as a waste after it is used, which entails wasteful spending and a waste of resources.

In view of this, there has been proposed a sheet binding apparatus that does not use a metal needle in order to reduce labor upon recycling, reduce the waste of resources and recycle a sheet (Japanese Patent Application Laid-Open No. 6-72060). However, in the above-mentioned sheet binding apparatus, binding force cannot be adjusted because a binding area cannot be changed. There has also been proposed a sheet binding apparatus that includes plural blades as a half-blanking portion not using a metal needle, wherein binding force can be adjusted by changing the half-blanking direction of the plural blades (Japanese Patent Application Laid-Open No. 2009-51661).

However, when the sheet bundle is bound by a half-blanking without using a metal needle such as the above-mentioned half-blanking portion, a binding portion or a binding area has to increase in order to further strengthen the binding of the sheet bundle.

In this case, it is considered that plural types of cutters, each having a different shape and different binding area, are prepared beforehand, and the cutter according to the purpose is selected from the plural types of cutters so as to perform a binding process.

However, the configuration of selectively using the plural types of cutters entails problems that it takes time to change the cutter and the productivity is decreased.

An object of the present invention is to be capable of setting a binding area, where an asperity is formed on a sheet bundle, to be an optional size, while preventing the deterioration in productivity.

SUMMARY OF THE INVENTION

An aspect of the invention is a sheet processing apparatus that forms asperity on a sheet bundle, which includes plural sheets, so as to bind the sheet bundle, including: a pair of rotating members having a concave and convex portions on the outer periphery; a moving portion that moves at least one of the pair of the rotating members so as to nip the sheet bundle by the pair of the rotating members or release the sheet bundle; and a controlling portion that controls the moving portion to allow the pair of rotating members to rotate with a concave portion of one rotating member and a convex portion of the other meshed with each other while nipping the sheet bundle or releasing the sheet bundle.

Another aspect of the present invention is a sheet processing apparatus that forms asperity on a sheet bundle, which includes plural sheets, so as to bind the sheet bundle, including: a rotating member having a concave and convex portions on the outer periphery; a guide member having a concave and convex portions; a moving portion that moves at least one of the rotating member and the guide member so as to nip the sheet bundle by the rotating member and the guide member, or release the sheet bundle; and a controlling portion that controls the moving portion to allow the rotating member to rotate with a concave portion of the rotating member and a convex portion of the guide member meshed with each other while nipping the sheet bundle or releasing the sheet bundle.

According to the present invention, the binding area where the asperity is formed on the sheet bundle can be set to have an optional size, while preventing the deterioration in productivity, binding force can be adjusted, and further, the binding position can be set to an optional position to the sheet bundle in the rotating direction of the rotating member. Accordingly, an optimum binding can be done according to the thickness of the sheet bundle, while preventing the deterioration in productivity.

Further features of the present invention will become apparent from the following description of exemplary embodiments with reference to the attached drawings.

DESCRIPTION OF THE EMBODIMENTS

Exemplary embodiments of the present invention will be illustratively described below with reference to the drawings. The size, material, and shape of the components described in the embodiments below, and the relative arrangement of these components should appropriately be modified according to a configuration of an apparatus to which the present invention is applied, and various conditions. Therefore, it is construed that the scope of the present invention is not limited to these, in so far as any special descriptions are not given.

An image forming apparatus provided with a sheet processing apparatus will illustratively be described in order to describe the embodiment. In the description below, the image forming apparatus provided with a sheet processing apparatus will firstly be described, and then, the sheet processing apparatus will be described.

Figure 19:
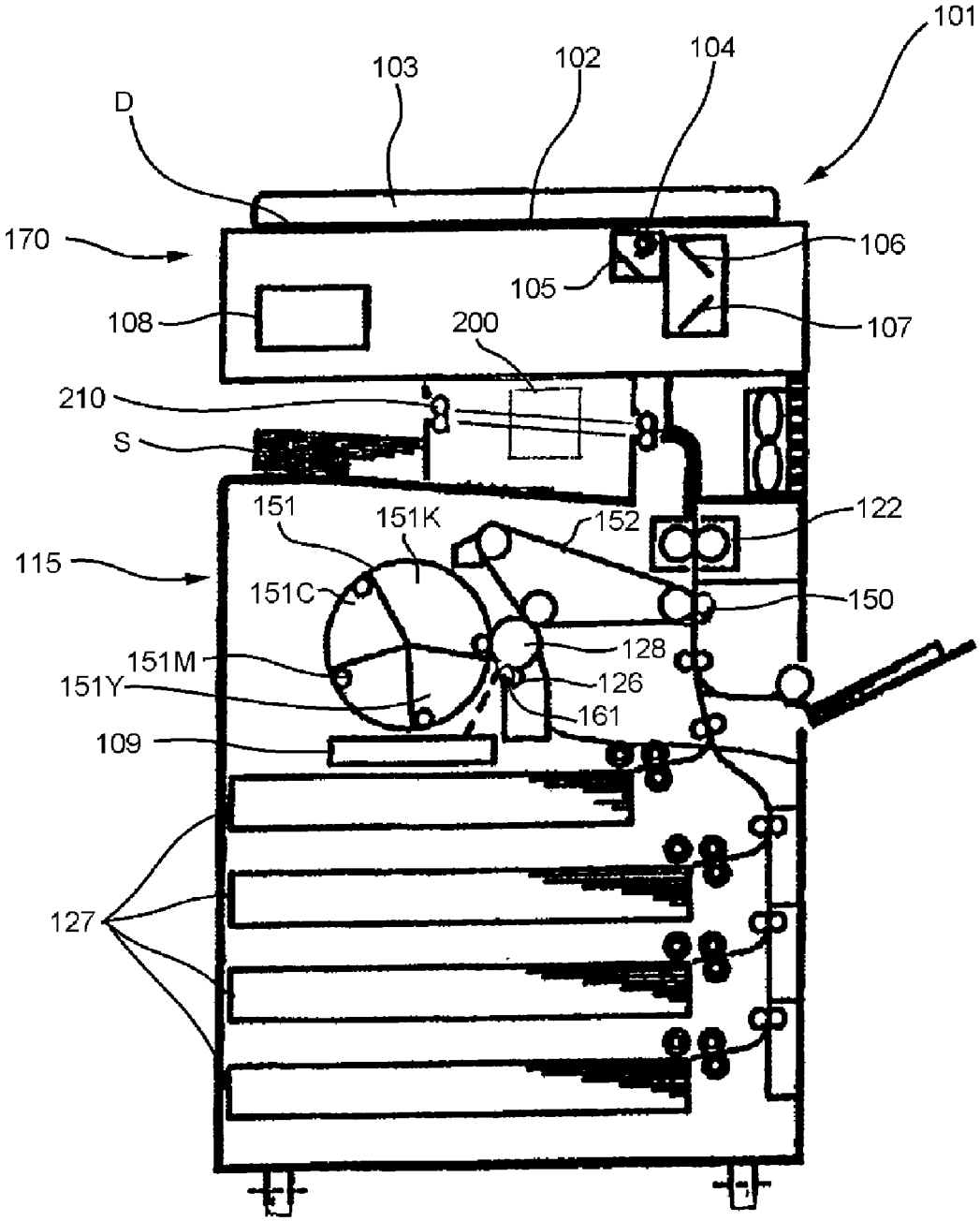
FIG. 19 is a sectional view of an image forming apparatus.

An image forming apparatus provided with a sheet processing apparatus will firstly be described with reference to FIG. 19. FIG. 19 is a sectional view of the image forming apparatus.

As illustrated in FIG. 19, an image forming apparatus 101 includes an image reading portion 170 and an image forming portion 115. An original base plate 102 made of a transparent glass plate is fixed on the image reading portion 170. A document D, which is placed at a predetermined position on the original base plate 102 with an image surface facing downwardly, is pressed and fixed by a document pressing plate 103. An optical system including a lamp 104 for irradiating the document D and reflection mirrors 105, 106, and 107 for guiding an optical image of the irradiated document D to an image processing unit 108 is provided below the original base plate 102. The lamp 104 and the reflection mirrors 105, 106, and 107 move with a predetermined speed to scan the document D.

The image forming portion 115 includes a photosensitive drum 128, a primary charging roller 161, a rotary development unit 151, an intermediate transfer belt 152, a transfer roller 150, a cleaner 126, etc. An optical image is irradiated to the photosensitive drum 128 from a laser unit 109 based upon image data, whereby an electrostatic latent image is formed on the surface of the photosensitive drum 128. The primary charging roller 161 uniformly charges the surface of the photosensitive drum 128 before the irradiation of the laser beam. The rotary development unit 151 deposits toners of magenta (M), cyan (C), yellow (Y), and black (K) onto the electrostatic latent image formed on the surface of the photosensitive drum 128 so as to form a toner image. The toner image developed onto the surface of the photosensitive drum 128 is transferred onto the intermediate transfer belt 152, and the toner image on the intermediate transfer belt 152 is transferred onto a sheet S by the transfer roller 150. The cleaner 126 removes the toner remaining on the photosensitive drum 128 after the toner image is transferred.

The rotary development unit 151 will be described. The rotary development unit 151 employs a rotary development system. It includes a development device 151K, development device 151Y, development device 151M, and development device 151C, and can rotate with a motor (not illustrated). When a monochromatic toner image is formed on the photosensitive drum 128, the development device 151K is rotated and moved to the development position proximate to the photosensitive drum 128 to perform the development. Similarly, when a full-color toner image is formed, the rotary development unit 151 is rotated to arrange the respective development devices at the development position, whereby the development is carried out successively for every color.

The toner image developed onto the photosensitive drum 128 by the rotary development unit 151 is transferred onto the intermediate transfer belt 152. The toner image on the intermediate transfer belt 152 is transferred onto the sheet S by the transfer roller 150. The sheet S is fed from a sheet cassette 127.

A fixing device 122 is provided at the downstream side of the image forming portion 115 in order to fix the toner image onto the conveyed sheet S as a permanent image. The sheet S having the toner image fixed thereon by the fixing device 122 is conveyed to a sheet processing apparatus 200 where a process such as a binding process is selectively carried out. Specifically, the sheet is stacked onto a predetermined position (e.g., a process tray) of the sheet processing apparatus, and aligned. A sheet bundle including the aligned plural sheets is selectively formed with asperity, whereby the sheets are bonded and bound. The sheet or the sheet bundle is discharged to a discharge portion 125, which is at the outside of the apparatus, by a pair of discharge rollers 210.

[First Embodiment]

Figure 1A:
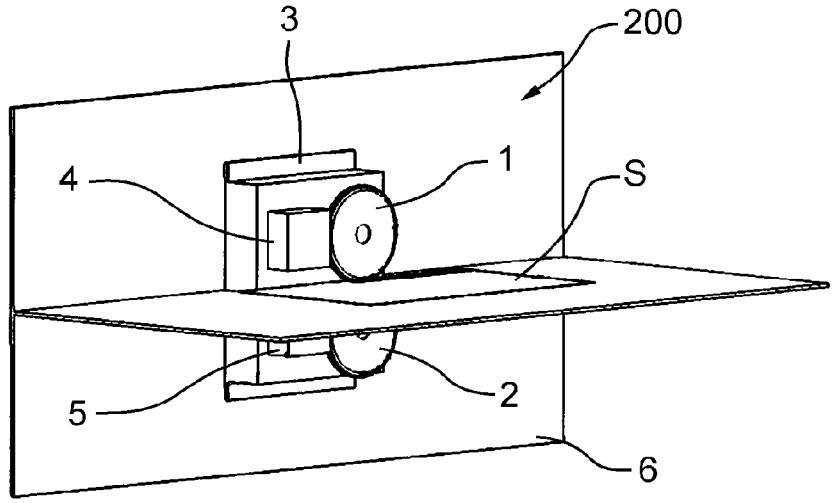
FIGS. 1A and 1B are perspective views illustrating a sheet processing apparatus according to a first embodiment.
Figure 1B:
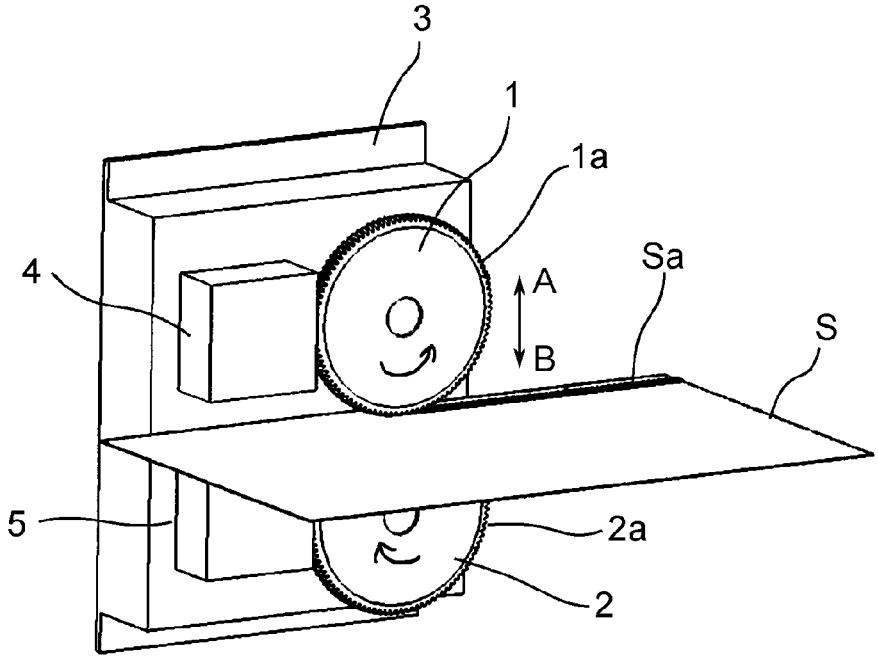

The sheet processing apparatus according to a first embodiment will next be described with reference to FIGS. 1A to 6. The sheet processing apparatus 200 is a sheet processing apparatus that binds the sheet bundle including plural sheets without using a binding member such as staples. As illustrated in FIGS. 1A and 1B, the sheet processing apparatus 200 has a pair of rotating members 1 and 2. The rotating member 1 has an uneven portion 1*a* having concave and convex portions formed continuously on the outer periphery, while the rotating member 2 has similarly an uneven portion 2*a* having concave and convex portions. The pair of the rotating members 1 and 2 rotates as nipping the sheet bundle S or release the sheet bundle S with a concave portion of one rotating member and a convex portion of the other meshed with each other, whereby the sheet bundle S is formed with asperity in the thickness direction. With this configuration, the pair of rotating members 1 and 2 bonds the sheets to bind the sheet bundle S.

Figure 2A:
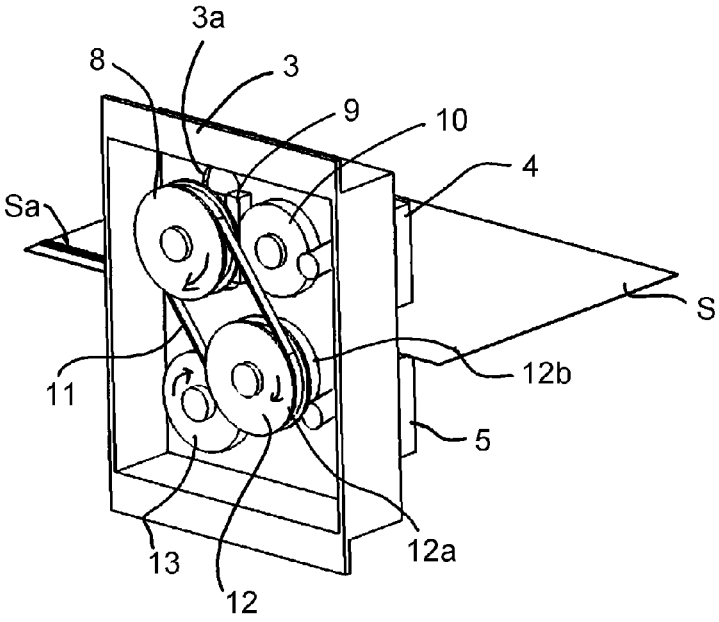
FIGS. 2A, 2B and 2C are perspective views and a transparent view of the sheet processing apparatus according to the first embodiment.
Figure 2B:
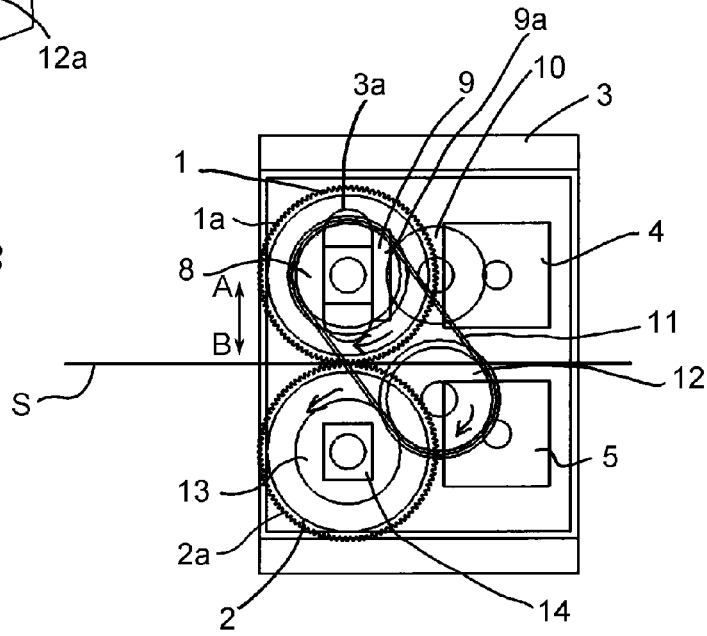
Figure 2C:
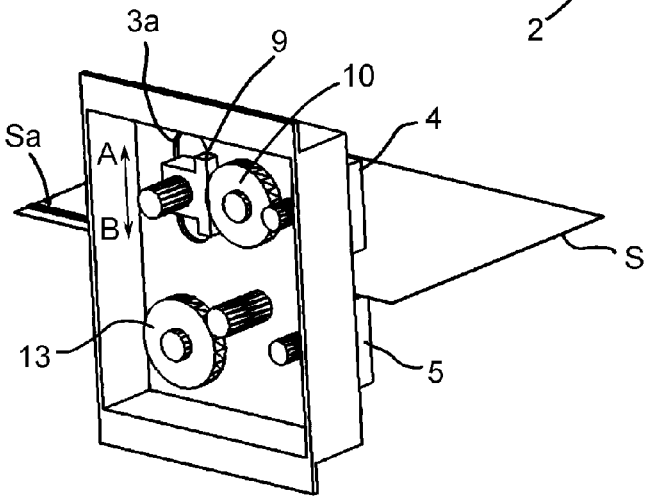
Figure 5:
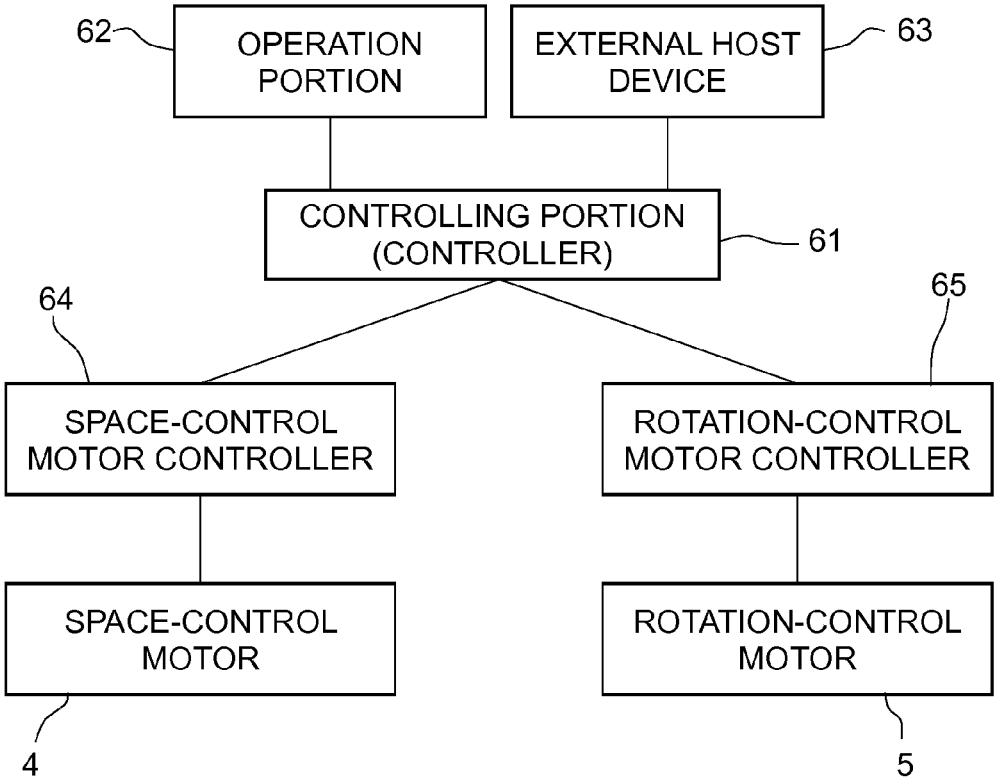
FIG. 5 is a control block diagram of the sheet processing apparatus according to the first embodiment.

As illustrated in FIGS. 2A, 2B and 2C, the rotating member 1 and the rotating member 2 each are supported by a support member 3 through a movable bearing 9 and a bearing 14. The support member 3 is provided at a main-body side plate 6. A motor 5 transmits a drive to a gear pulley 12 so as to rotate the rotating member 1 through a pulley portion 12*a* of the gear pulley 12, a timing belt 11, and a pulley 8. Further, the motor 5 rotates the rotating member 2 through a gear portion 12*b* of the gear pulley 12 and a gear 13. As described above, the rotating member 1 and the rotating member 2 have uneven portions (uneven shape) 1*a* and 2*a* made of concave and convex portions formed continuously on the circumference. The rotating members 1 and 2 are driven to rotate with the uneven portions 1*a* and 2*a* meshed with each other. A controlling portion (controller) 61 controls the motor 5 through a rotation-control motor controller 65 as illustrated in FIG. 5.

A moving portion for moving the rotating member 1 in the thickness direction of the sheet bundle is provided in order to be capable of changing the space between the rotating member 1 and the rotating member 2. The moving portion is configured as described below. The rotating member 1 is rotatably supported by the movable bearing 9. A gear portion (rack gear) 9*a* of the movable bearing 9 is coupled to the motor 4, which can rotate in the forward direction and reverse direction, through an idler gear 10. Due to the forward and reverse rotations of the motor 4, the movable bearing 9 moves in the direction of A or direction of B in FIG. 2B along an elongated hole (guide hole) 3*a* of the support member 3, whereby the rotating member 1 moves in the vertical direction (in the thickness direction of the sheet bundle). Thus, the space between the rotating member 1 and the rotating member 2 can be changed. The controlling portion (controller) 61 controls the motor 4 through a space-control motor controller 64 as illustrated in FIG. 5.

Figure 6:
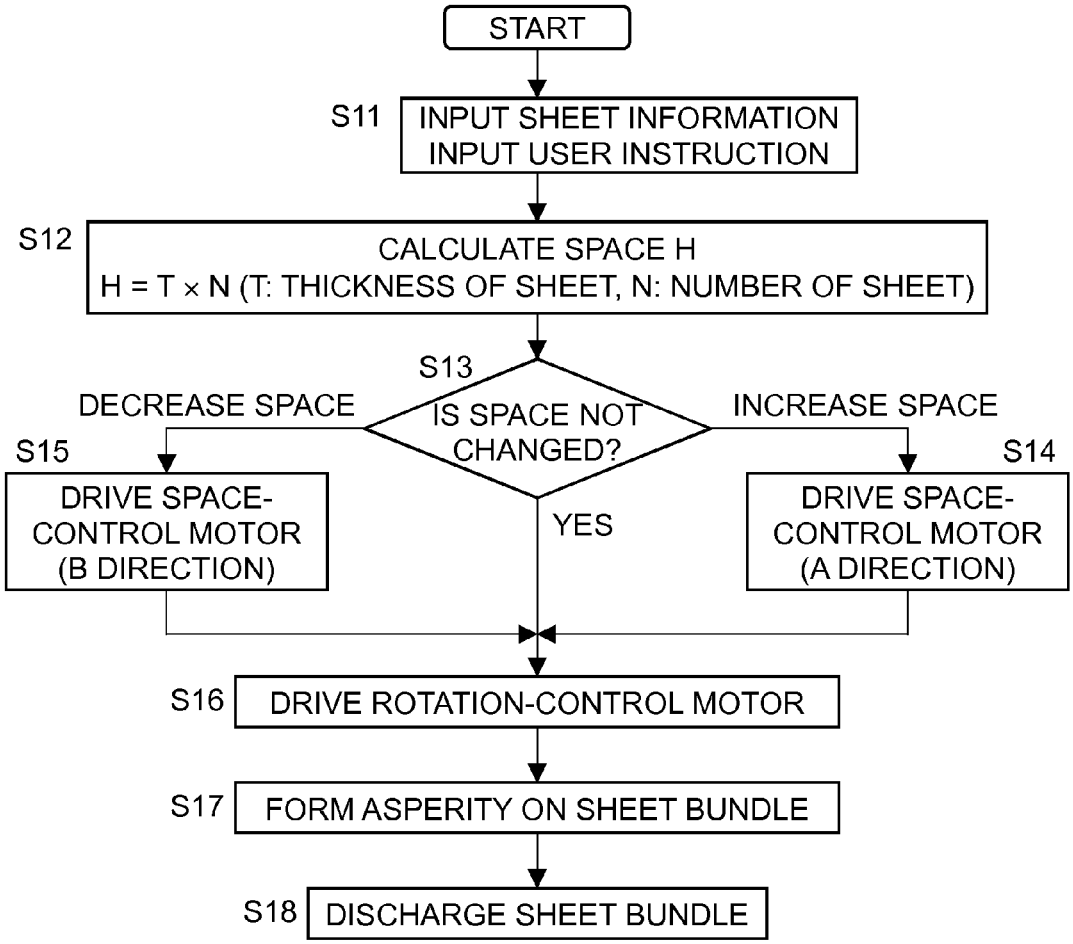
FIG. 6 is a control flowchart of the sheet processing apparatus according to the first embodiment.
Figure 7A:
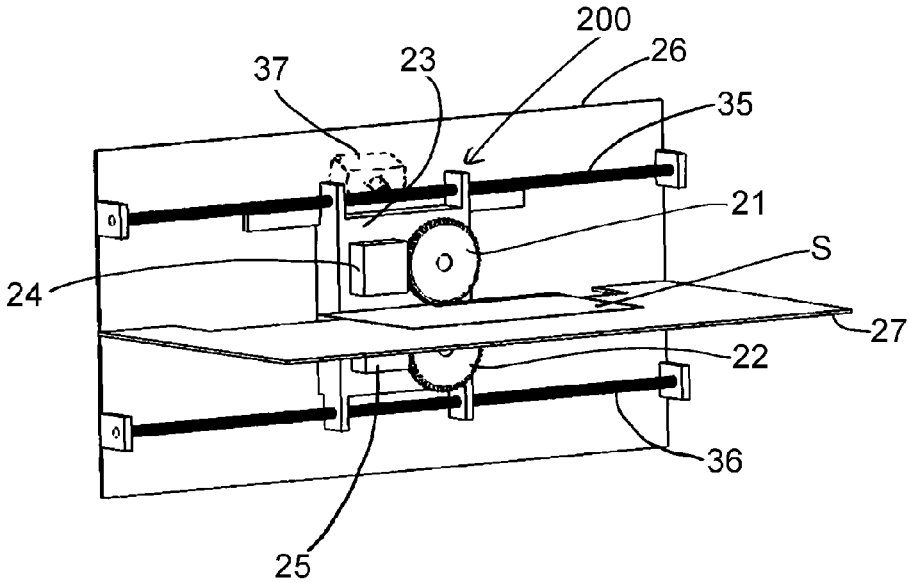
FIGS. 7A and 7B are perspective views illustrating a sheet processing apparatus according to a second embodiment.
Figure 7B:
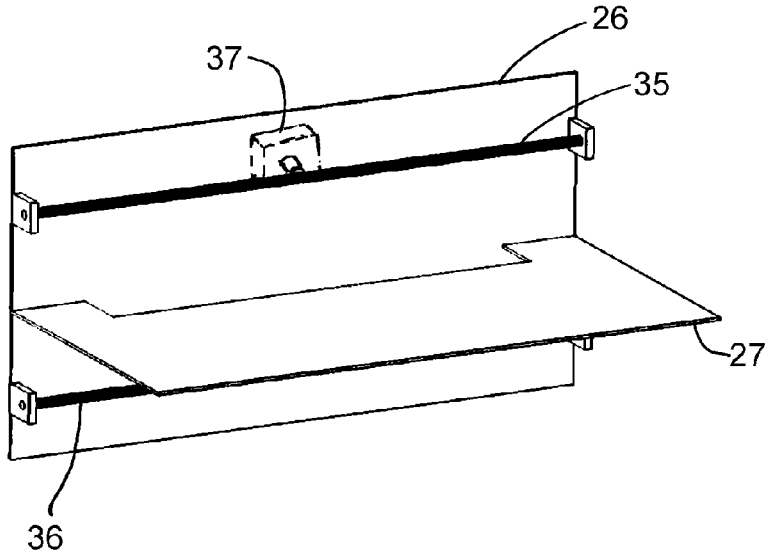

The control of the operation of the sheet processing apparatus by the controlling portion (controller) 61 will be described with reference to FIGS. 5 and 6. Since the controlling portion (controller) 61 changes the space between the rotating member 1 and the rotating member 2, the sheet processing apparatus can move the binding position or change the range of the binding area as repeating the nip of the sheet bundle and the cancel of the nip of the sheet bundle by the rotating member 1 and the rotating member 2.

The drives of the motors 4 and 5 are controlled according to the information (the thickness or number of the sheet) of the sheet forming one sheet bundle and the instruction (binding position, etc.) by a user. The information (the thickness or number of the sheet) of the sheet forming one sheet bundle and the instruction (binding position, etc.) by a user are input from an operation portion 62 provided to the image forming apparatus or an external host device 63 such as a personal computer.

When the sheet processing apparatus 200 performs the sheet binding process, the sheet conveyed to the sheet processing apparatus 200 is successively stacked at a predetermined position (process tray 7) and aligned. Then, the controlling portion 61 determines the space between the rotating member 1 and the rotating member 2 (step S12) based upon the information (the thickness or number of the sheet) of the sheet forming one sheet bundle (step S11). Here, as the information of the sheet, the space H corresponding to the thickness of the sheet bundle is calculated with the use of a thickness t of a sheet and a number N of the sheet ($H=t\times N$). When receiving the signal from the controlling portion, the space-control motor controller 64 instructs the rotation angle of the space-control motor 4 (step S13).

The space between the rotating member 1 and the rotating member 2 is determined according to the thickness of the sheet bundle in order to form an appropriate asperity for binding of the sheet bundle. With this, the sheet is not damaged more than necessary by adjusting the nip pressure for nipping the sheet bundle by the rotating members 1 and 2. Specifically, when the calculated value (the thickness of the sheet bundle) is greater than a predetermined thickness set beforehand from a result of an experiment, the rotating member 1 is moved in the direction of A in FIG. 1B in order to increase the space between the pair of rotating members 1 and 2 (step S14). On the other hand, when the calculated value (the thickness of the sheet bundle) is smaller than the predetermined thickness set beforehand, the rotating member 1 is moved in the direction of B in FIG. 1B in order to decrease the space between the pair of rotating members 1 and 2 (step S15). When the calculated value (the thickness of the sheet bundle) is equal to the predetermined thickness set beforehand, the space between the pair of rotating members 1 and 2 is not changed. In this way, the rotating member 1 is moved by the rotation of the space-control motor 4, thereby facing the rotating member 2 with the space corresponding to the thickness of the sheet bundle and being meshed with the rotating member 2.

Figure 3A:
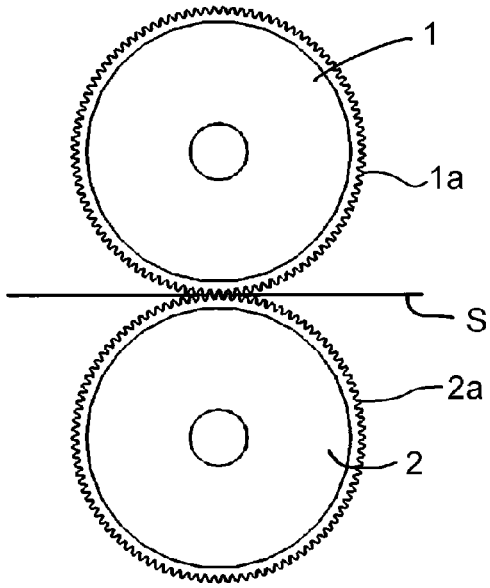
FIGS. 3A, 3B and 3C are partially enlarged views of the sheet processing apparatus according to the first embodiment.
Figure 3B:
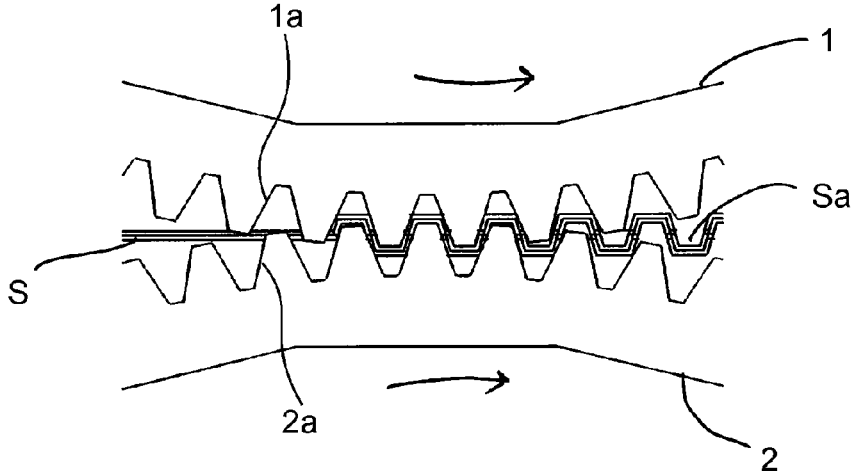
Figure 3C:
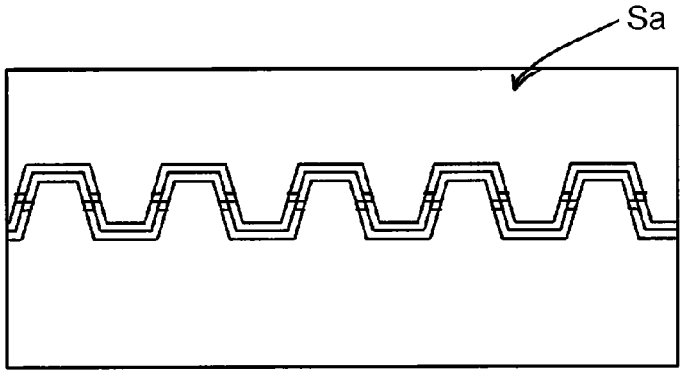

Thereafter, the sheet bundle is moved by an unillustrated moving portion, and the rotation-control motor controller 65 instructs the rotation angle of the rotation-control motor 5. Due to the rotation of the rotation-control motor 5 (step S14), the rotating member 1 and the rotating member 2 are driven to rotate, whereby an uneven emboss shape Sa in a line is formed at a part of the sheet bundle S as illustrated in FIGS. 3A, 3B and 3C (step S17) to bind the sheet bundle. Then, the sheet bundle is discharged (step S18).

As described above, the binding (binding position or binding area) for the sheet bundle is formed at the position desired by a user. With this, there is no need to provide plural types of binding portions, with the result that the sheet processing apparatus can be mounted to a cheap and compact image forming apparatus.

Figure 4A:
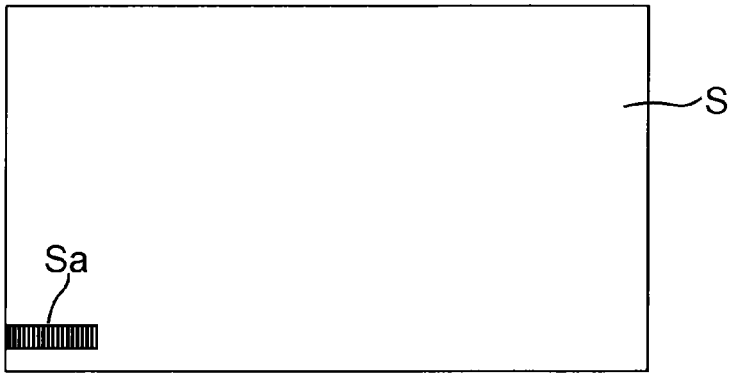
FIGS. 4A and 4B are top views of a sheet bundle that is subject to a binding process.
Figure 4B:
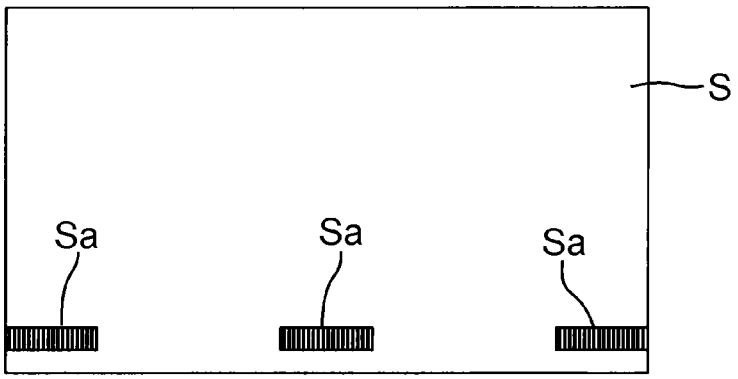

Since the rotating members 1 and 2 having the uneven portions 1*a* and 2*a* respectively on the outer periphery nip the sheet bundle, and the rotating members 1 and 2 are rotated to bind the sheet bundle, the binding area on which the asperity is formed to the sheet bundle can easily be set to have an optional size. Specifically, since the rotation angle instructed to the rotation-control motor 5 is changed, the uneven emboss shape Sa is formed at the entire end portion of the sheet bundle, whereby the sheet bundle can be bound into a book-like shape. When the space-control motor 4 is rotated to move the rotating member 1 in the vertical direction during the conveyance of the sheet bundle in order to nip the sheet bundle or release the sheet bundle, only the corner of the sheet bundle is bound as illustrated in FIG. 4A, or the sheet bundle can partially be bound with a space as illustrated in FIG. 4B. Thus, an optimum binding can be made according to the number or thickness of the sheet forming the sheet bundle.

Since the binding process can be performed while conveying the sheet bundle, the deterioration in productivity, which is caused by temporarily stopping the sheet bundle during the execution of the binding process, can be prevented. Further, the binding area of the sheet bundle can be set to be an optional size by a pair of the rotating members, whereby the apparatus can be downsized. As described above, the deterioration of the productivity is prevented, and the apparatus can be downsized, while the binding area of the sheet bundle can be set to be optional size, and the binding position to the sheet bundle can be set to the optional position in the rotating direction of the rotating member. Accordingly, the sheet processing apparatus can perform the optimum binding according to the number or thickness of the sheet forming the sheet bundle.

[Second Embodiment]

A sheet processing apparatus according to a second embodiment will be described with reference to FIGS. 7A to 13. As illustrated in FIGS. 7A to 8B, a sheet processing apparatus 200 has a pair of rotating members 21 and 22. The rotating member 21 has uneven portions 21*a* and 21*b* having concave and convex portions formed continuously on the outer periphery, while the rotating member 22 has similarly uneven portions 22*a* and 22*b* having concave and convex portions. The pair of the rotating members 21 and 22 rotate as nipping the sheet bundle with the uneven portions 21*a* and 22*a* or uneven portions 21*b* and 22*b* meshed with each other so that a concave portion of one rotating member and a convex portion of the other are meshed with each other or releasing the sheet bundle, whereby the sheet bundle is formed with asperity in the thickness direction. With this configuration, the pair of rotating members 21 and 22 bonds the sheets to bind the sheet bundle. In the first embodiment, the sheet bundle is formed with asperity while the sheet bundle is moving. In this embodiment, the sheet bundle is formed with asperity by movement of the pair of rotating members 21 and 22.

The uneven portion of the rotating member 21 has the first uneven portion 21*a* and the second uneven portion 21*b* having a depth (height difference, distance) between the concave portion and the convex portion greater than that of the first uneven portion 21*a*. Similarly, the uneven portion of the rotating member 22 has the first uneven portion 22*a* and the second uneven portion 22*b* having a depth between the concave portion and the convex portion greater than that of the first uneven portion 22*a*. The pair of the rotating members 21 and 22 can rotate with the respective phases agreed with each other in order that the uneven portions having the same depth are meshed with each other.

In this embodiment, one set of the pair of the rotating members is provided. However, the number of the sets of the rotating member pair is not limited thereto, but may appropriately be set as needed. The uneven portion of each of the rotating members is not limited to the one described above. The rotating member may be configured such that two or more uneven portions, each having a different depth between the concave portion and the convex portion, are provided, and the uneven portions having the same depth are meshed with each other to bind the sheet bundle.

Figure 12:
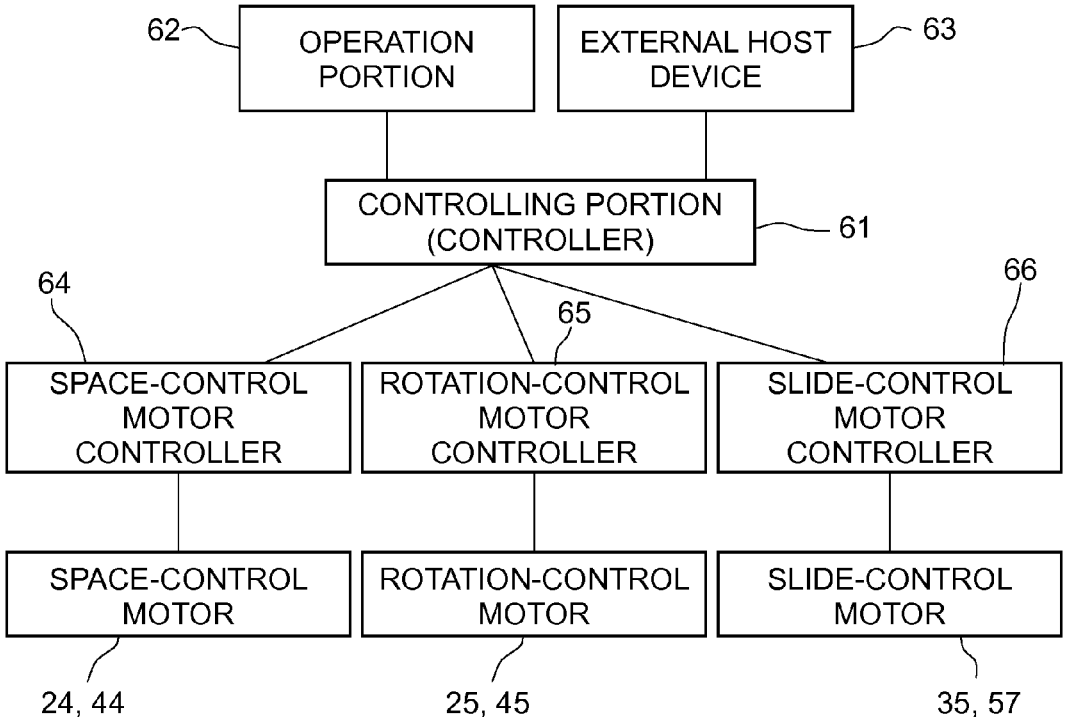
FIG. 12 is a control block diagram of the sheet processing apparatus according to the second and a third embodiments.

As illustrated in FIGS. 7A to 8B, the rotating member 21 and the rotating member 22 each are supported by a support member 23 through a movable bearing 29 and a bearing (not illustrated). A motor 25 transmits a drive to a gear pulley 32 so as to rotate the rotating member 21 through a pulley portion 32*a* of the gear pulley 32, a timing belt 31, and a pulley 28. Further, the motor 25 rotates the rotating member 22 through a gear portion 32*b* of the gear pulley 32 and a gear 33. As described above, the rotating member 21 and the rotating member 22 have uneven portions (uneven shape) made of concave and convex portions formed continuously on the circumference. The rotating members 21 and 22 are driven to rotate with the uneven portions 21*a* and 21*b* or the uneven portions 22*a* and 22*b* meshed with each other. The controlling portion (controller) 61 controls the motor 25 through a rotation-control motor controller 65 as illustrated in FIG. 12.

The sheet processing apparatus 200 has a moving portion for moving the rotating member 21 in the thickness direction of the sheet bundle in order to change the space between the rotating member 21 and the rotating member 22. The moving portion is configured as described below. The rotating member 21 is rotatably supported by the movable bearing 29. The gear portion (rack gear) 29*a* of the movable bearing 29 is coupled to the motor 24, which can rotate in the forward direction and reverse direction, through an idler gear 30. Due to the forward and reverse rotations of the motor 24, the movable bearing 29 moves in the direction of A or direction of B in FIGS. 8A and 8B along an elongated hole (guide hole) 23*a* of the support member 23, whereby the rotating member 21 moves in the vertical direction (in the thickness direction of the sheet bundle). Thus, the space between the rotating member 21 and the rotating member 22 can be changed. The controlling portion (controller) 61 controls the motor 24 through a space-control motor controller 64 as illustrated in FIG. 12.

As illustrated in FIGS. 7A to 8B, the pair of the rotating members 21 and 22 is rotatably supported by the support member 23 in the conveying direction of the sheet bundle. The support member 23 is formed with slide holes 23*b* and 23*c*. The slide holes 23*b* and 23*c* of the support member 23 are fitted to slide bars 35 and 36 formed on the main-body side plate 26 respectively. Thus, the support member 23 can move in the conveying direction of the sheet bundle along the slide bars 35 and 36. A motor 37 supported to the main-body side plate 26 can rotate in the forward direction and reverse direction. The motor 37 is meshed with the gear portion 23*d* at the support member 23. When the motor 37 is driven, the support member 23 can slidably move in the conveying direction of the sheet bundle. The controlling portion (controller) 61 controls the motor 37 through a slide-control motor controller 66 as illustrated in FIG. 12.

Figure 13:
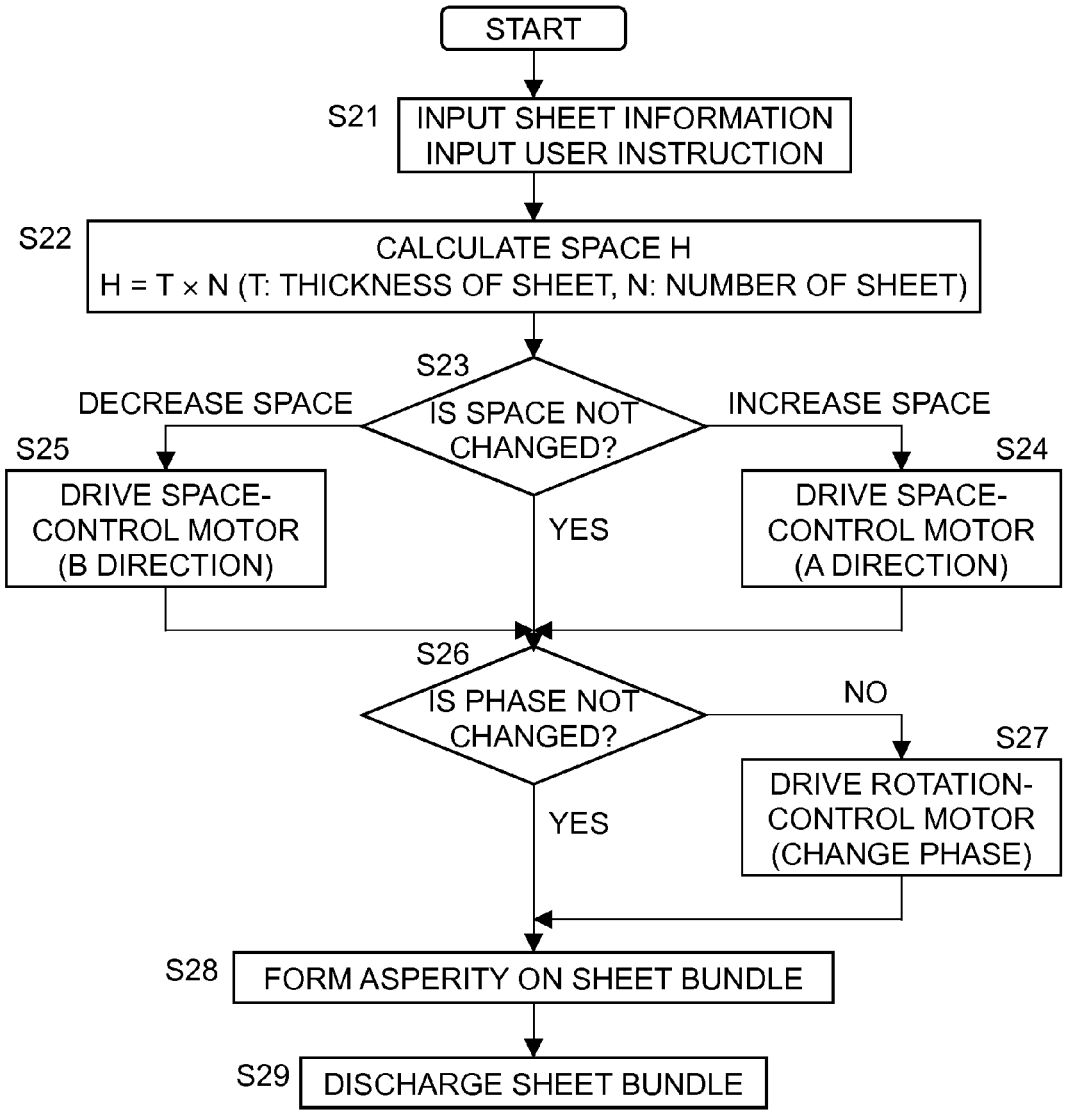
FIG. 13 is a control flowchart of the sheet processing apparatus according to the second and the third embodiments.

The control of the operation of the sheet processing apparatus by the controlling portion (controller) 61 will be described with reference to FIGS. 12 and 13. In the sheet processing apparatus, the drives of the motors 24, 25, and 37 are controlled by the controlling portion (controller) 61 according to the information (the thickness or number of the sheet) of the sheet forming one sheet bundle and the instruction (binding position, etc.) by a user. The information (the thickness or number of the sheet) of the sheet forming one sheet bundle and the instruction (binding position, etc.) by a user are input from an operation portion 62 provided to the image forming apparatus or an external host device 63 such as a personal computer as illustrated in FIG. 12.

When the binding process is performed by the sheet processing apparatus 200, the sheet conveyed to the sheet processing apparatus 200 is successively stacked at a predetermined position (process tray 27) and aligned. Then, the controlling portion 61 determines the space between the rotating member 21 and the rotating member 22 (step S22) based upon the information (the thickness or number of the sheet) of the sheet forming one sheet bundle (step S21). Here, as the information of the sheet, the space H corresponding to the thickness of the sheet bundle is calculated with the use of a thickness t of a sheet and a number N of the sheet ($H=t\times N$). When receiving the signal from the controlling portion, the space-control motor controller 64 instructs the rotation angle of the space-control motor 24 (step S23).

Figure 8A:
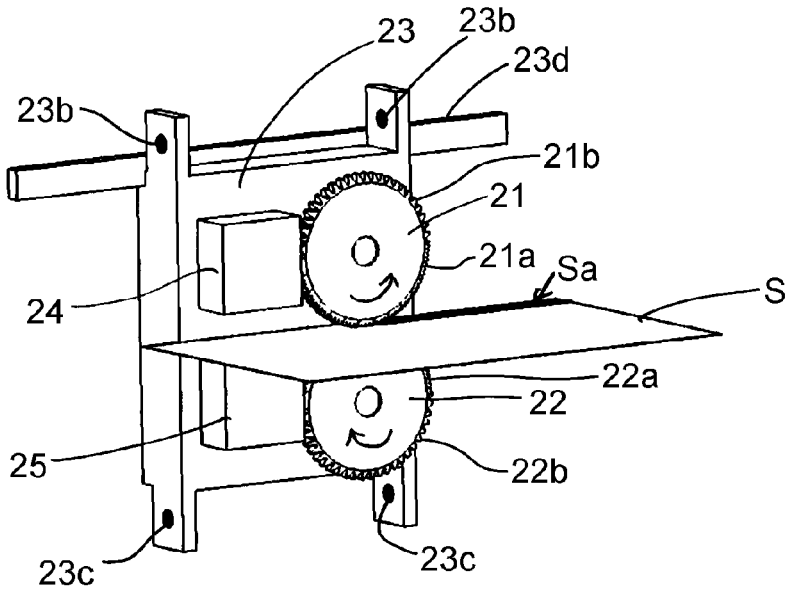
FIGS. 8A and 8B are perspective views of the sheet processing apparatus according to the second embodiment.
Figure 8B:
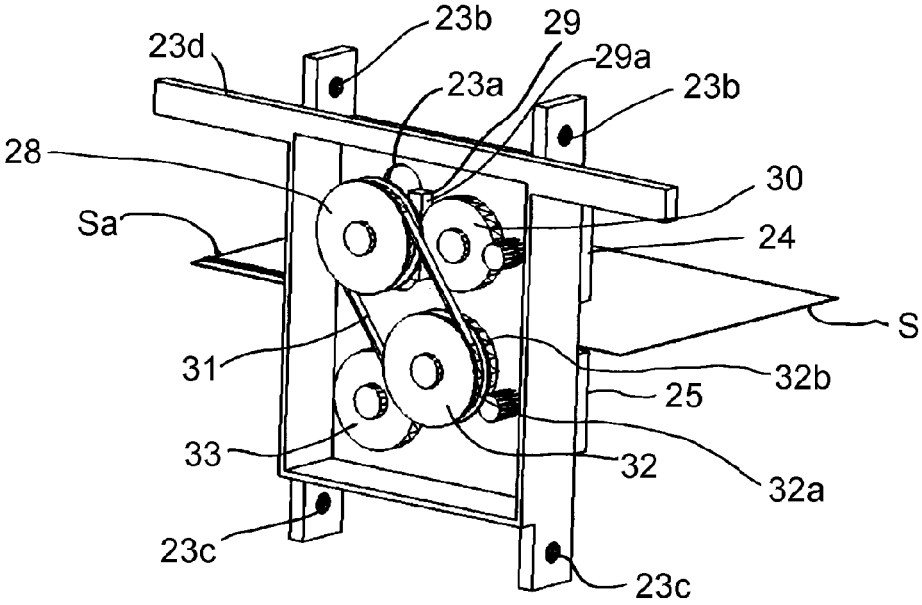

Specifically, when the calculated value (the thickness of the sheet bundle) is greater than a predetermined thickness set beforehand, the rotating member 21 is moved in the direction of A in FIGS. 8A and 8B in order to increase the space between the pair of rotating members 21 and 22 (step S24). On the other hand, when the calculated value (the thickness of the sheet bundle) is smaller than the predetermined thickness set beforehand, the rotating member 21 is moved in the direction of B in FIGS. 8A and 8B in order to decrease the space between the pair of rotating members 21 and 22 (step S25). When the calculated value (the thickness of the sheet bundle) is equal to the predetermined thickness set beforehand, the space between the pair of rotating members 21 and 22 is not changed. In this way, the rotating member 21 is moved by the rotation of the space-control motor 24, thereby facing the rotating member 22 with the space corresponding to the thickness of the sheet bundle and being meshed with the rotating member 22.

Figure 9A:
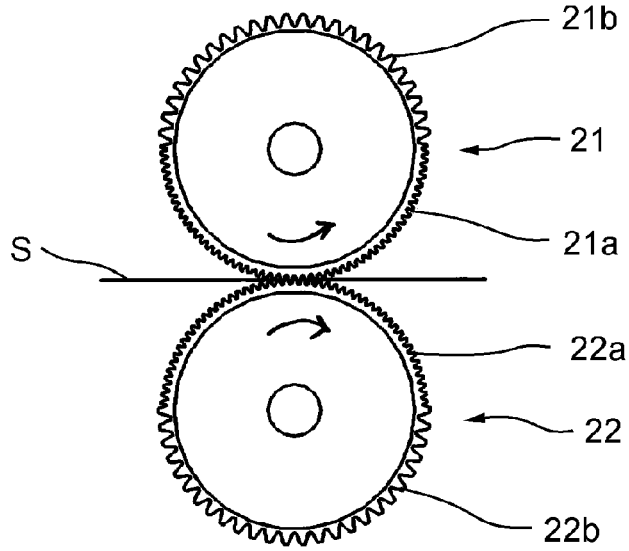
FIGS. 9A and 9B are partially enlarged views of the sheet processing apparatus according to the second embodiment.
Figure 9B:
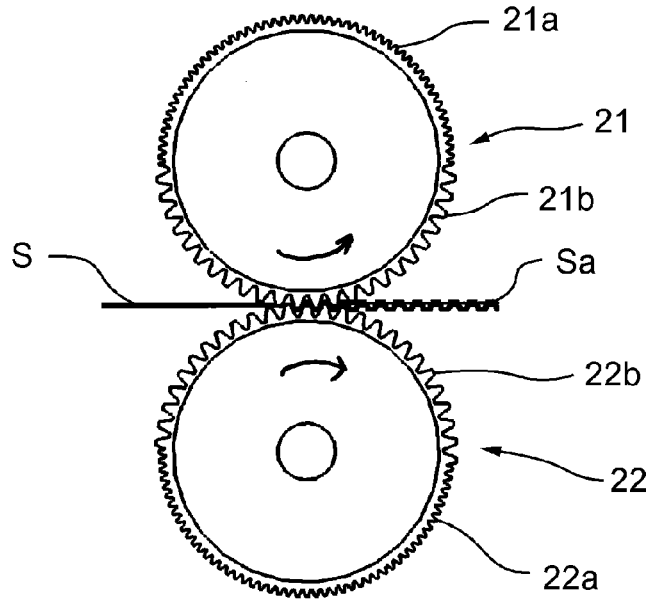

In this case, the phases of the rotating members 21 and 22 are changed based upon the stacked number or type of the sheets forming the sheet bundle (steps S26, S27), whereby the uneven emboss shape Sa formed on the sheet bundle S can be changed. For example, when the thickness of the sheet bundle based upon the number or the thickness of the sheet is not more than a predetermined thickness, the binding process is performed with the use of the uneven portions 21*a* and 22*a*, having a small depth, of the rotating members 21 and 22 as illustrated in FIG. 9A. On the other hand, when the thickness of the sheet bundle exceeds the predetermined thickness, the binding process is performed with the use of the uneven portions 21*b* and 22*b*, having a great depth, of the rotating members 21 and 22 as illustrated in FIG. 9B.

Figure 10A:
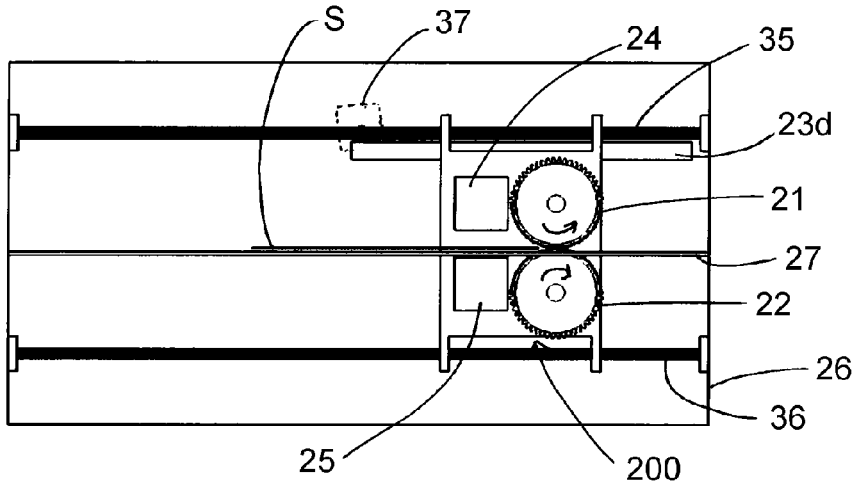
FIGS. 10A, 10B and 10C are sectional views of the sheet processing apparatus according to the second embodiment.
Figure 10B:
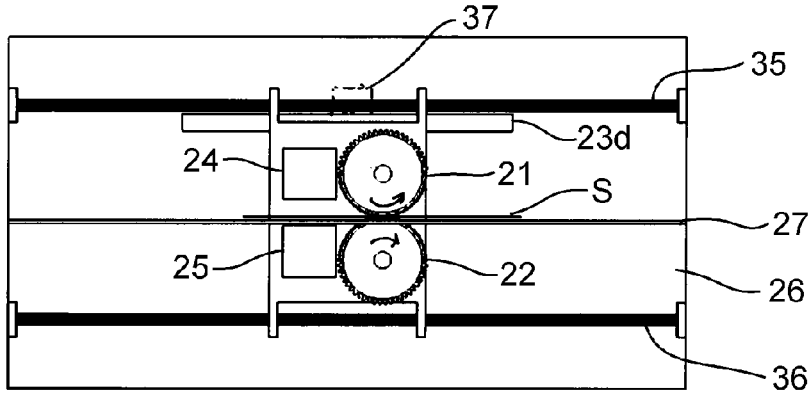
Figure 10C:
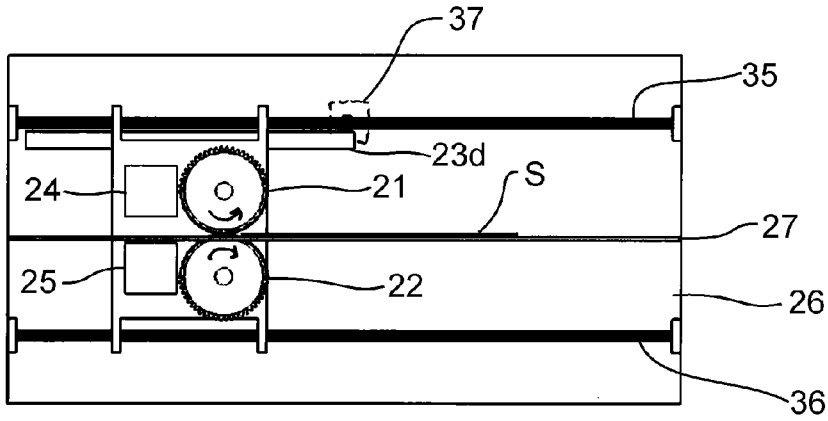

Then, the slide-control motor 37 is rotated, whereby the support member 23 supporting the rotating members 21 and 22 is moved as illustrated in FIGS. 10A, 10B and 10C (step S28). The rotation-control motor 25 rotates with the movement of the support member 23 to rotate the rotating members 21 and 22, whereby the uneven emboss shape Sa is formed in a line at a part of the sheet bundle S to bind the sheet bundle. In this case, the space-control motor 24 is driven together with the rotation-control motor 25 so as to repeat the contact/separation of the uneven portions 21*a* and 22*a* of the rotating members 21 and 22 and the drive of the rotating members 21 and 22, with the result that the binding of the sheet bundle illustrated in FIGS. 4A and 4B can be done. The space-control motor 24 is driven together with the rotation-control motor 25 so as to repeat the contact/separation of the uneven portions 21*b* and 22*b* of the rotating members 21 and 22 and the drive of the rotating members 21 and 22, with the result that the binding of the sheet bundle illustrated in FIGS. 11A and 11B can be done. Thereafter, the sheet bundle is discharged (step S29).

Figure 11A:
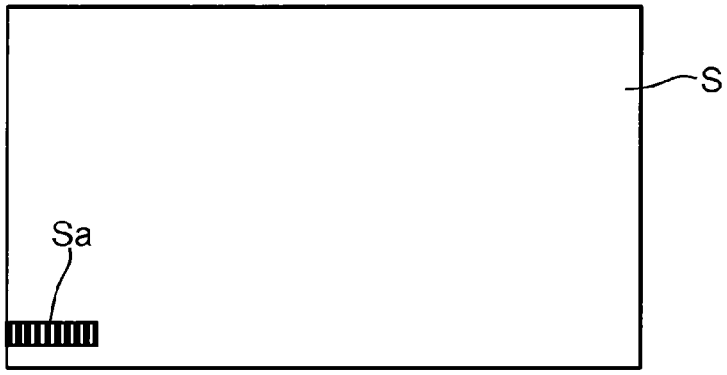
FIGS. 11A and 11B are top views of the sheet bundle that is subject to the binding process.
Figure 11B:
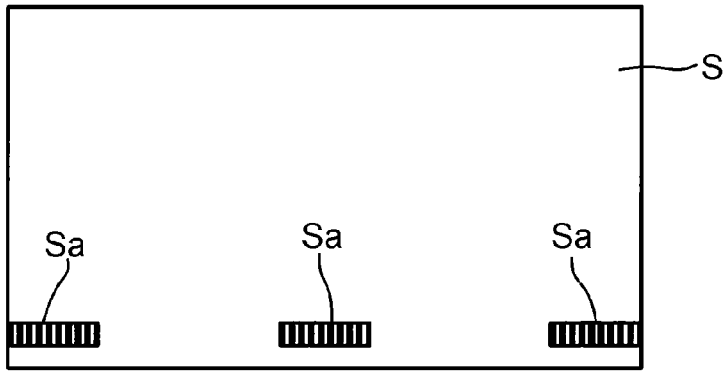

As described above, since the rotating members 21 and 22 having the uneven portions on the outer periphery nip the sheet bundle, and the rotating members 21 and 22 are rotated to bind the sheet bundle, the binding area on which the asperity is formed to the sheet bundle can easily be set to have an optional size. Specifically, since the rotation angle instructed to the rotation-control motor 25 is changed, the uneven emboss shape Sa is formed at the entire end portion of the sheet bundle, whereby the sheet bundle can be bound into a book-like shape. The rotation of the rotating members 21 and 22 by the rotation-control motor 25, the movement of the support member 23 by the slide-control motor 37, and the contact/separation (nip of the sheet bundle and the cancel of the nip of the sheet bundle) of the rotating members 21 and 22 by the space-control motor 4 are combined and performed. With this, only the corner of the sheet bundle can be bound as illustrated in FIGS. 4A and 11A or the sheet bundle can be partially bound with a space as illustrated in FIGS. 4B and 11B. Thus, an optimum binding can be made according to the number or thickness of the sheet forming the sheet bundle.

When the binding process of the sheet bundle is performed, the binding process can be executed as in the same manner described above by moving the support member, which supports the rotating member, in the sheet conveying direction without using the conveying portion (not illustrated) for conveying the sheet bundle. Therefore, the same effect can be obtained. The plural asperity shapes formed on the sheet bundle can be changed by changing the phases of the uneven portions of the rotating members according to the number or thickness of the sheet forming the sheet bundle. For example, when the sheet bundle is thin, the uneven emboss shape having a small depth is used, while the uneven emboss shape having a great depth is used when the sheet bundle is thick. Accordingly, the optimum binding is possible.

[Third Embodiment]

A sheet processing apparatus according to a third embodiment will be described with reference to FIGS. 15A to 18C, and FIGS. 12 and 13. As illustrated in FIGS. 15A to 16B, a sheet processing apparatus 200 has a rotating member 41 and a guide member 42. The rotating member 41 has uneven portions 41*a* and 41*b* having concave and convex portions formed continuously on the outer periphery, while the guide member 42 has uneven portions 42*a* and 42*b* meshed with the uneven portions 41*a* and 41*b*. The rotating member 41 and the guide member 42 rotate as nipping the sheet bundle or releasing the sheet bundle with the uneven portions 41*a* and 42*a* or uneven portions 41*b* and 42*b* so that a concave portion of the rotating member 41 and a convex portion of the guide member 42 are meshed with each other, whereby the sheet bundle is formed with asperity in the thickness direction. With this configuration, the rotating member 41 and the guide member 42 bond the sheets to bind the sheet bundle. In this embodiment, the sheet bundle is formed with asperity by movement of the rotating member 41 on the guide member 42.

The uneven portion of the rotating member 41 has the first uneven portion 41*a* having the semicircular length of the rotating member 41 and the second uneven portion 41*b* having a depth greater than that of the first uneven portion 41*a* and having the semicircular length of the rotating member 41. Similarly, the uneven portion of the guide member 42 has the first uneven portion 42*a* having the semicircular length of the rotating member 41 and the second uneven portion 42*b* having a depth greater than that of the first uneven portion 42*a* and having the semicircular length of the rotating member 41. The rotating member 41 rotates so as to repeatedly separate from and be meshed with the guide member 42 with the respective phases agreed with each other in order that the uneven portions having the same depth are meshed with each other. In this embodiment, plural first uneven portions 42*a* and plural second uneven portions 42*b* are alternately formed to the guide member 42 according to the phases of the first uneven portion 41*a* and the second uneven portion 41*b* of the rotating member 41 in the width direction, which is orthogonal to the conveying direction of the sheet bundle. However, the present invention is not limited thereto. For example, the first uneven portion 42*a* and the second uneven portion 42*b* may be formed separately at both sides in the width direction. When the binding process is performed, the sheet bundle is moved in the width direction in order that one end of the sheet bundle, which is to be bound, in the width direction is aligned to the uneven portion of the guide member that is the start of the binding process. Then, as described above, the rotating member 41 rotates so as to repeatedly separate from and be meshed with the guide member 42 with the respective phases agreed with each other, wherein the uneven portions having the same depth are meshed with each other.

In this embodiment, one set of the pair of the rotating member and the guide member is provided. However, the number of the sets of the rotating member and the guide member is not limited thereto, but may appropriately be set as needed. The uneven portion of the rotating member and the guide member is not limited to the one described above. The rotating member may be configured such that two or more uneven portions, each having a different depth, are provided, and the uneven portions having the same depth are meshed with each other to bind the sheet bundle.

As illustrated in FIGS. 15A to 16B, the rotating member 41 is supported by a support member 43 through a movable bearing 49. A motor 45 transmits a drive to a gear 48 through an idler gear 53 so as to rotate the rotating member 41. The guide member 42 is fixed to a predetermined position of the sheet processing apparatus 200. The guide member 42 is formed integral with the process tray 27. The rotating member 41 is driven to rotate with the state in which the uneven portions 41*a* and 41*b* are meshed respectively with the uneven portions 42*a* and 42*b* of the guide member 42. The controlling portion (controller) 61 controls the motor 45 through the rotation-control motor controller 65 as illustrated in FIG. 12.

The sheet processing apparatus 200 has a moving portion for moving the rotating member 41 in the thickness direction of the sheet bundle in order to change the space between the rotating member 41 and the guide member 42. The moving portion is configured as described below. The rotating member 41 is rotatably supported by the movable bearing 49. The gear portion (rack gear) 49*a* of the movable bearing 49 is coupled to the motor 44, which can rotate in the forward direction and reverse direction, through an idler gear 50. Due to the forward and reverse rotations of the motor 44, the movable bearing 49 moves in the direction of A or B in FIGS. 16A and 16B along an elongated hole (guide hole) 43*a* of the support member 43, whereby the rotating member 41 moves in the vertical direction (in the thickness direction of the sheet bundle). Thus, the space between the rotating member 41 and the guide member 42 can be changed according to the thickness of the sheet bundle, or the separation and abutment with the sheet bundle can selectively be performed. The controlling portion (controller) 61 controls the motor 44 through the space-control motor controller 64 as illustrated in FIG. 12.

As illustrated in FIGS. 15A to 16B, the rotating member 41 is rotatably supported by the support member 43 in the width direction that is orthogonal to the conveying direction of the sheet bundle. The support member 43 is formed with a slide hole 43*b*. The slide hole 43*b* of the support member 43 is fitted to a slide bar 55 formed on the main-body side plate 46. Thus, the support member 43 can move in the width direction that is orthogonal to the conveying direction of the sheet bundle along the slide bar 55. A motor 57 supported to the main-body side plate 46 can rotate in the forward direction and reverse direction. The motor 57 is meshed with the gear portion 43*d* at the support member 43. When the motor 57 is driven, the support member 43 can slidably move in the width direction of the sheet bundle. The controlling portion (controller) 61 controls the motor 57 through the slide-control motor controller 66 as illustrated in FIG. 12.

The control of the operation of the sheet processing apparatus by the controlling portion (controller) 61 will be described with reference to FIGS. 12 and 13. In the sheet processing apparatus, the drives of the motors 44, 45, and 57 are controlled by the controlling portion (controller) 61 according to the information (the thickness or number of the sheet) of the sheet forming one sheet bundle and the instruction (binding position, etc.) by a user. The information (the thickness or number of the sheet) of the sheet forming one sheet bundle and the instruction (binding position, etc.) by a user are input from the operation portion 62 provided to the image forming apparatus or the external host device 63 such as a personal computer as illustrated in FIG. 12.

When the binding process is performed by the sheet processing apparatus 200, the sheet conveyed to the sheet processing apparatus 200 is successively stacked at a predetermined position (process tray 27) and aligned. Then, the controlling portion 61 determines the space between the rotating member 41 and the guide member 42 (step S22) based upon the information (the thickness or number of the sheet) of the sheet forming one sheet bundle (step S21). Here, as the information of the sheet, the space H corresponding to the thickness of the sheet bundle is calculated with the use of a thickness t of a sheet and a number N of the sheet (H=t×N). When receiving the signal from the controlling portion, the space-control motor controller 64 instructs the rotation angle of the space-control motor 44 (step S23).

Figure 16A:
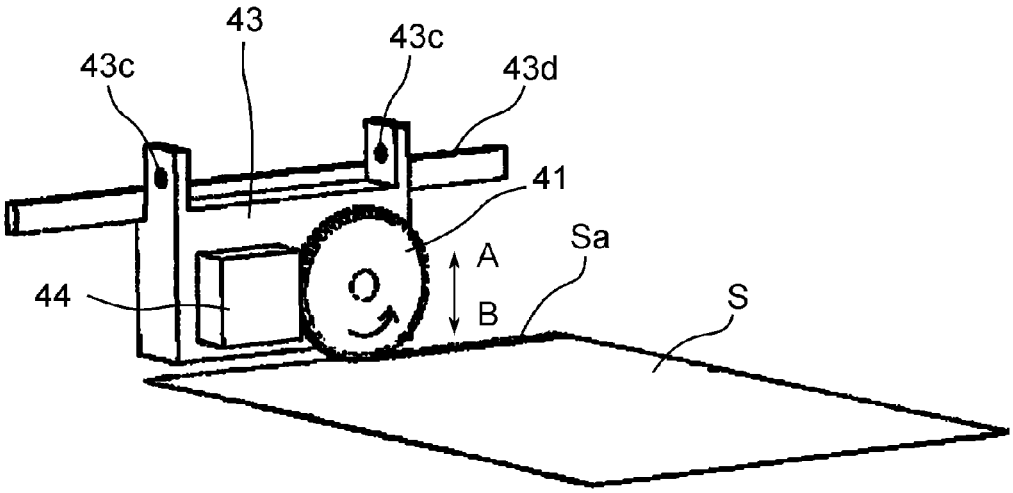
FIGS. 16A and 16B are perspective views illustrating the sheet processing apparatus according to the third embodiment.
Figure 16B:
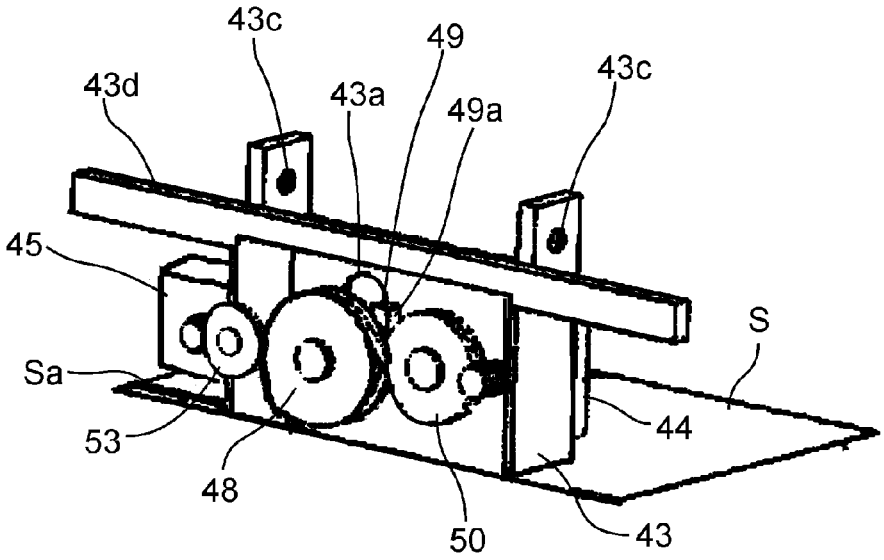

Specifically, when the calculated value (the thickness of the sheet bundle) is greater than a predetermined thickness set beforehand, the rotating member 41 is moved in the direction of A in FIGS. 16A and 16B in order to increase the space between the rotating member 41 and the guide member 42 (step S24). On the other hand, when the calculated value (the thickness of the sheet bundle) is smaller than the predetermined thickness set beforehand, the rotating member 41 is moved in the direction of B in FIGS. 16A and 16B in order to decrease the space between the rotating member 41 and the guide member 42 (step S25). When the calculated value (the thickness of the sheet) is equal to the predetermined thickness set beforehand, the space between the rotating member 41 and the guide member 42 is not changed. In this way, the rotating member 41 is moved by the rotation of the space-control motor 44, thereby facing the guide member 42 with the space corresponding to the thickness of the sheet bundle and being meshed with the guide member 42.

Figure 17A:
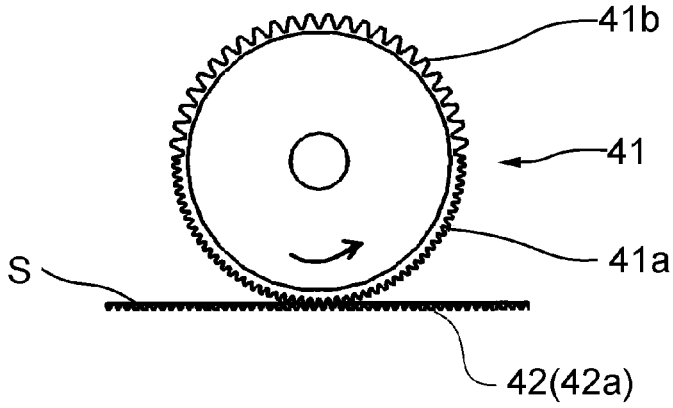
FIGS. 17A and 17B are partially enlarged views of the sheet processing apparatus according to the third embodiment.
Figure 17B:
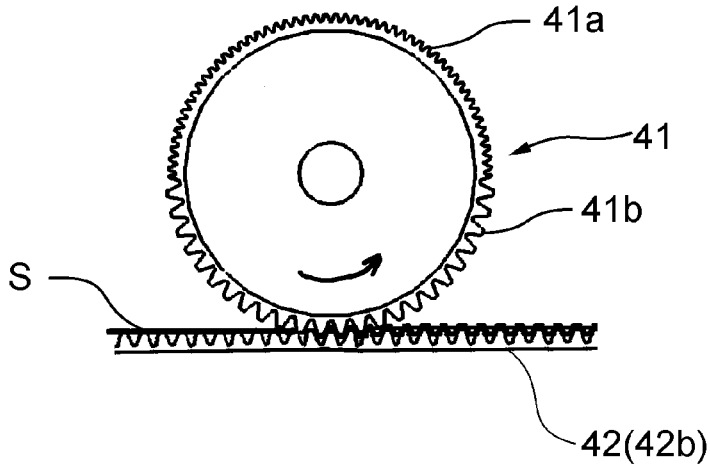

In this case, the phase of the rotating member 41 is changed based upon the stacked number of the sheets or type of the sheets forming the sheet bundle (steps S26, S27), whereby the uneven emboss shape Sa formed on the sheet bundle S can be changed as illustrated in FIGS. 17A and 17B. For example, when the thickness of the sheet bundle based upon the number or the thickness of the sheet is not more than a predetermined thickness, the binding process is performed with the use of the uneven portions 41*a* and 42*a*, having a small depth, of the rotating member 41 and the guide member 42 as illustrated in FIG. 17A. On the other hand, when the thickness of the sheet bundle exceeds the predetermined thickness, the binding process is performed with the use of the uneven portions 41*b* and 42*b*, having a great depth, of the rotating member 41 and the guide member 42 as illustrated in FIG. 17B.

Figure 18A:
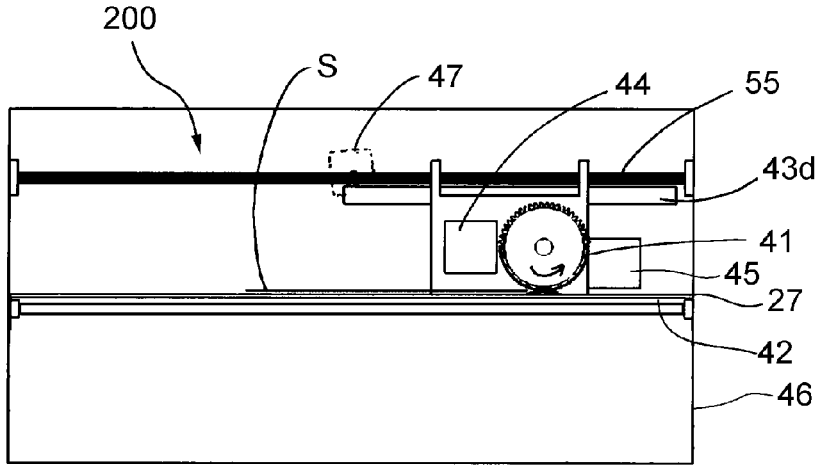
FIGS. 18A, 18B and 18C are sectional views of the sheet processing apparatus according to the third embodiment.
Figure 18B:
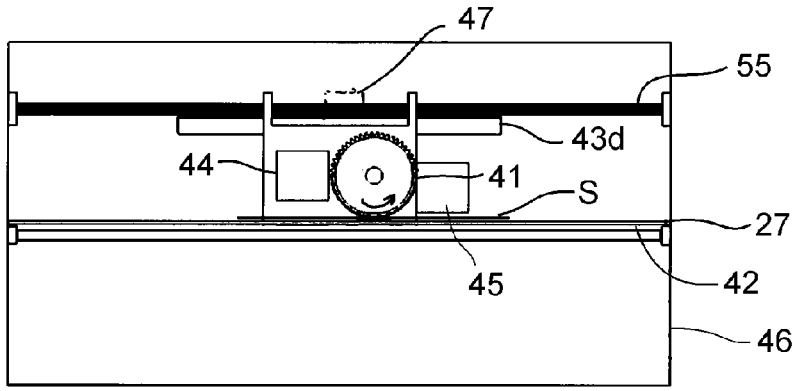
Figure 18C:
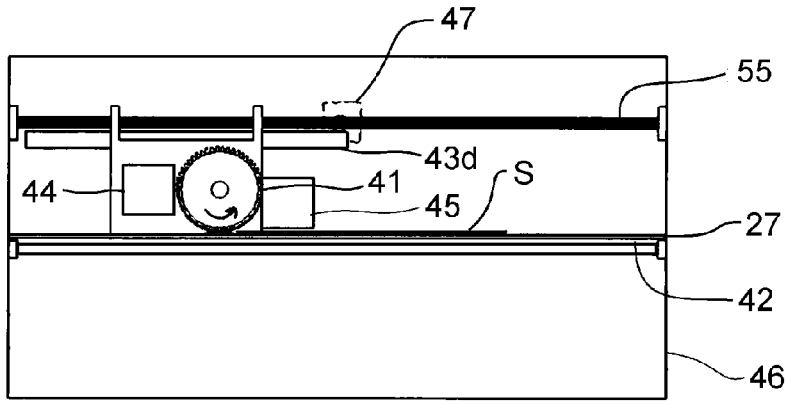

Then, the slide-control motor 57 is rotated, whereby the support member 43 supporting the rotating member 41 is moved as illustrated in FIGS. 18A, 18B and 18C (step S28). The rotation-control motor 45 rotates with the movement of the support member 43 to rotate the rotating member 41, whereby the uneven emboss shape Sa is formed in a line at a part of the sheet bundle S to bind the sheet bundle. In this case, the space-control motor 44 is driven together with the rotation-control motor 45 so as to repeat the contact/separation of the rotating member 41 and the guide member 42 and the drive of the rotating member 41 to the guide member 42, with the result that the binding of the sheet bundle illustrated in FIGS. 4A and 4B or FIGS. 11A and 11B can be done. Thereafter, the sheet bundle is discharged (step S29).

More specifically, when the rotating member 41 illustrated in FIGS. 17A and 17B makes a half rotation with either one of the first uneven portion 41*a* and the second uneven portion 41*b* according to the thickness of the sheet bundle, and then, moves upward to separate from the sheet bundle, the output (sheet bundle) illustrated in FIGS. 4A and 11A can be obtained. The rotating member 41 makes a half rotation with either one of the first uneven portion 41*a* and the second uneven portion 41*b* according to the thickness of the sheet bundle, moves upward to separate from the sheet bundle, further makes a half rotation with the separated state, and then, is brought into pressed contact with the sheet bundle. This process is repeated, whereby the output (sheet bundle) illustrated in FIGS. 4B and 11B can be obtained. The guide member 42 illustrated in FIGS. 15A and 15B has the uneven portions, each having a different depth and being alternately provided with a semicircular pitch of the rotating member 41.

Therefore, the guide member 42 is shifted in the width direction by the semicircular pitch of the rotating member 41 according to the thick sheet bundle and the thin sheet bundle in order to form the asperity at both ends and the central part as illustrated in FIGS. 4B and 11B. Thereafter, the binding operation described above is performed to the sheet bundle to bind the sheet, and then, the sheet bundle is discharged.

The binding process in the width direction of the sheet bundle may be performed plural times in order to enhance secrecy of the sheet bundle. In this case, after the first binding is performed in the width direction of the sheet bundle, the sheet bundle is conveyed to the predetermined position by the unillustrated conveying portion. Then, the sheet bundle is temporarily stopped. The support member 43 that supports the rotating member 41 is moved in the direction reverse to the above-mentioned direction so as to nip again the stopped sheet bundle with the rotating member 41 and the guide member 42. The rotating member 41 and the guide member 42 again form the uneven emboss shape Sa on the sheet bundle to bind the sheet bundle, and then, the sheet bundle is discharged.

The rotating member 41 and the guide member 42 having the uneven portions on the outer periphery nip the sheet bundle, and the rotating member 41 is rotated to bind the sheet bundle, as described above. The rotation of the rotating member 41 by the rotation-control motor 45, the movement of the support member 43 by the slide-control motor 57, and the contact/separation (nip of the sheet bundle and the cancel of the nip of the sheet bundle) of the rotating member 41 and the guide member 42 by the space-control motor 44 are combined and performed. With this, only the corner of the sheet bundle can be bound as illustrated in FIGS. 4A and 11A or the sheet bundle can be partially bound with a space as illustrated in FIGS. 4B and 11B. Further, the sheet bundle is bound according to the number of the sheet or the thickness of the sheet forming the sheet bundle. Specifically, when the sheet bundle is thin, the uneven emboss shape having a small depth is used, while the uneven emboss shape having a great depth is used when the sheet bundle is thick. Thus, an optimum binding can be made according to the number or thickness of the sheet forming the sheet bundle. Even if there is no depth in the uneven portions, the distance between the rotating member and the guide member is held appropriate (the distance is increased as the sheet bundle becomes thicker) according to the thickness of the sheet bundle, whereby the effect same as that in the case in which there is a depth in the uneven portions can be obtained.

When the binding process of the sheet bundle is performed, the support member supporting the rotating member is moved in the sheet conveying direction, whereby the binding process can be performed in the same manner as the second embodiment, and the same effect can be obtained. The plural asperities formed on the sheet bundle can be changed according to the number or thickness of the sheet forming the sheet bundle by changing the phase of the uneven portion of the rotating member. Thus, the optimum binding can be done.

The both ends of the sheet bundle can be bound without providing plural binding portions. The sheet bundle is bound at plural portions, whereby the sheet bundle considering the secrecy can be formed with the simple configuration without using a metal needle.

[Other Embodiment]

Figure 14:
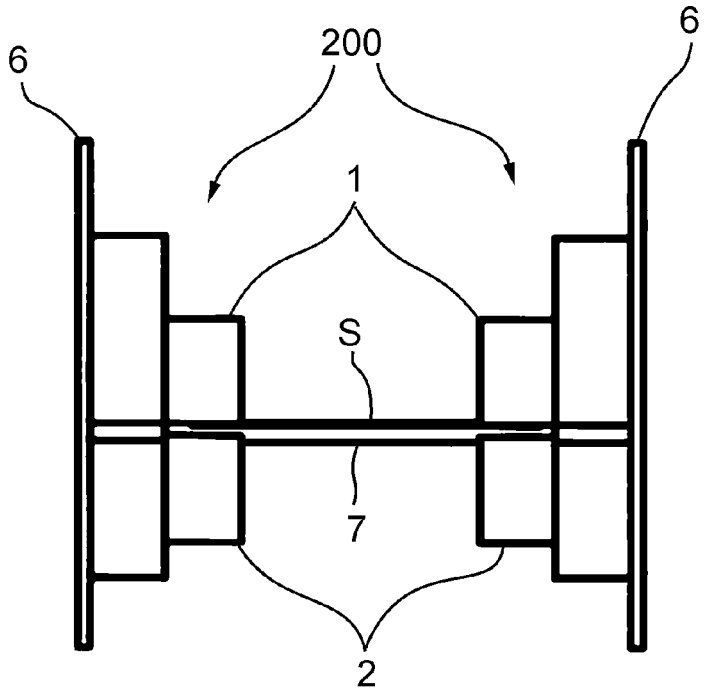
FIG. 14 is a front view illustrating an example of a configuration in which a pair of rotating members is provided at both sides of the sheet bundle.
Figure 15A:
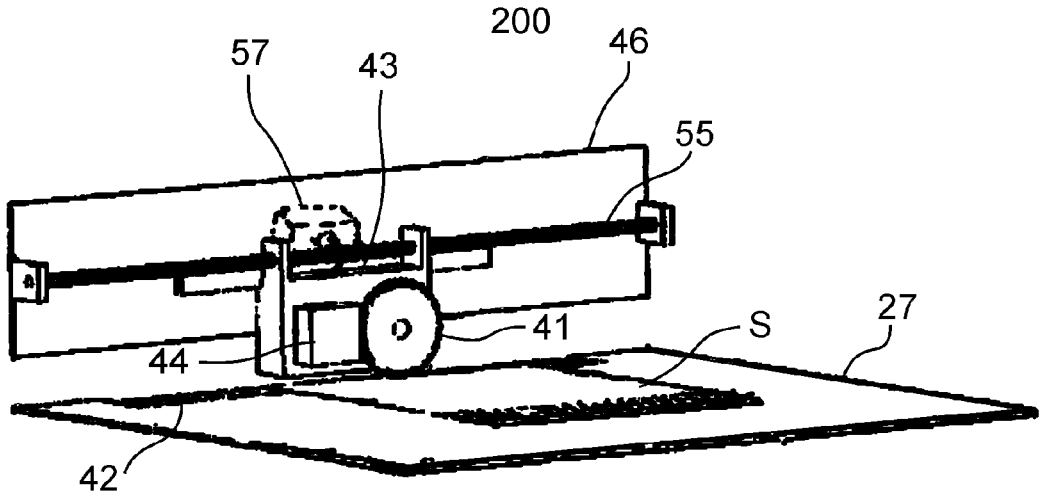
FIGS. 15A and 15B are perspective views illustrating a sheet processing apparatus according to the third embodiment.
Figure 15B:
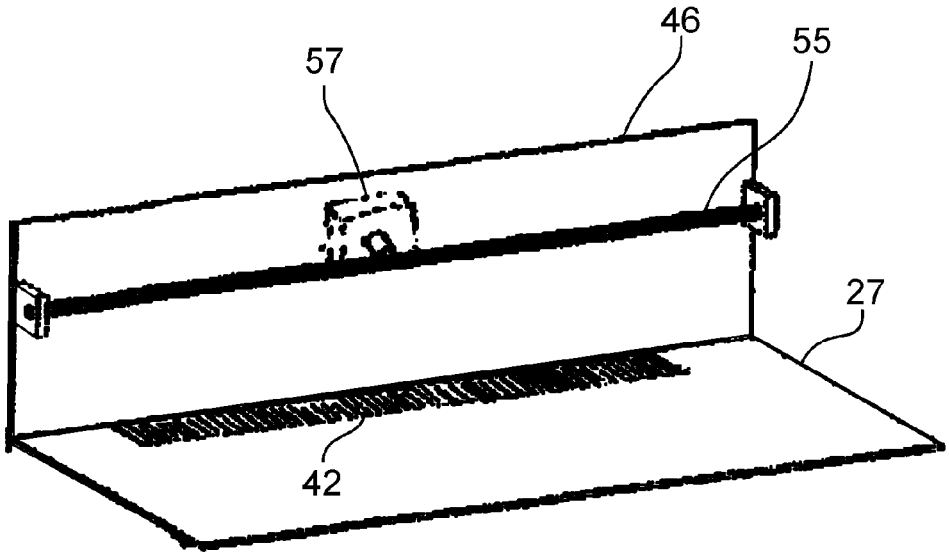

In the first and second embodiments, a pair of rotating members is arranged at one end in the conveying direction of the sheet bundle. However, the invention is not limited thereto. For example, pairs of rotating members 1 and 2 may be arranged at both ends in the conveying direction of the sheet bundle S as illustrated in FIG. 14. With this configuration, the both ends of the sheet bundle in the conveying direction can be bound, whereby the sheet bundle considering the secrecy can be formed with the simple configuration without using a metal needle.

In the above-mentioned embodiments, the uneven portion of the rotating member has concave and convex portions that are continuously formed. However, the invention is not limited thereto. For example, a rotating member, such as a notched gear, including the uneven portions formed intermittently on the outer periphery may be employed, and rotating members having other uneven portions may be employed.

In the second embodiment, one of the pair of the rotating members moves with respect to the other rotating member so as to increase (or decrease) the space between the opposing rotating members. However, the invention is not limited thereto. For example, the other rotating member may move with respect to one rotating member so as to increase (or decrease) the space between the opposing rotating members. Alternatively, both rotating members may move so as to increase (or decrease) the space between the opposing rotating members.

In the third embodiment, the rotating member of the rotating member and the guide member moves with respect to the guide member so as to increase (or decrease) the space between the rotating member and the guide member. However, the invention is not limited thereto. The guide member may move with respect to the rotating member so as to increase (or decrease) the space between the rotating member and the guide member. Alternatively, both the rotating member and the guide member may move so as to increase (or decrease) the space between the rotating member and the guide member.

In the embodiments described above, the moving portion for moving the rotating member or the guide member includes the gear portion provided to the movable bearing that rotatably supports the rotating member, and the motor (drive source) having the gear meshed with the gear portion. However, the invention is not limited thereto.

In the embodiments described above, a copying machine is illustrated as an example of the image forming apparatus, but the invention is not limited thereto. For example, other image forming apparatus such as a printer or facsimile, or other image forming apparatus such as a complex machine having these functions combined may be employed. The same effect can be obtained by applying the present invention to the sheet processing apparatus used in the image forming apparatuses described above.

In the embodiments described above, the sheet processing apparatus is formed integral with the image forming apparatus. However, the invention is not limited thereto. The sheet processing apparatus may be detachable to the image forming apparatus. The same effect can be obtained by applying the present invention to the sheet processing apparatus described above.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-135660, filed Jun. 5, 2009, and No. 2010-114384, filed May 18, 2010, which are hereby incorporated by reference herein in their entirety.

What is claimed is:

1. A sheet processing apparatus that forms asperity on a sheet bundle, which includes plural sheets, so as to bind the sheet bundle, comprising:

a pair of rotating members, each having concave and convex portions on the outer periphery, configured to nip the sheet bundle and rotate with the respective phases of the concave and convex portions aligned to mesh with each other to form the asperity on the sheet bundle;

a moving portion that moves at least one of the pair of the rotating members in a thickness direction of the sheet bundle; and a controlling portion configured to control the moving portion so that the moving portion moves at least one of the pair of rotating members in the thickness direction of the sheet bundle so as to nip the sheet bundle or separate from the sheet bundle during relative movement between the pair of rotating members and the sheet bundle to bind the sheet bundle.

2. The sheet processing apparatus according to claim 1, wherein the controlling portion controls the moving portion so that the moving portion moves at least one of the pair of the rotating members in the thickness direction of the sheet bundle to nip the sheet bundle or separate from the sheet bundle according to a position on the sheet bundle of a set binding area, and size of the set binding area.

3. The sheet processing apparatus according to claim 1, wherein the controlling portion controls the moving portion so that the moving portion moves at least one of the pair of the rotating members in the thickness direction of the sheet bundle to nip the sheet bundle or separate from the sheet bundle according to a position on the sheet bundle of a set binding area, size of the set binding area, and number of the set binding area.

4. The sheet processing apparatus according to claim 1, wherein the pair of the rotating members is supported rotatably by a support member which is movable along one end of the sheet bundle.

5. A sheet processing apparatus that forms asperity on a sheet bundle, which includes plural sheets, so as to bind the sheet bundle, comprising:

a rotating member having a concave and convex portions on the outer periphery;

a guide member, having a concave and convex portions which meshes with the concave and convex portions of the rotating member, configured to guide rotation of the rotating members with the respective phases of the concave and convex portions aligned to mesh with each other to form the asperity on the sheet bundle;

a moving portion that moves at least one of the rotating member and the guide member in a thickness direction of the sheet bundle; and a controlling portion configured to control the moving portion so that the moving portion moves at least one of the rotating member and the guide member in the thickness direction of the sheet bundle so as to nip the sheet bundle or separate from the sheet bundle during movement of the rotating member along the guide member to bind the sheet bundle.

6. The sheet processing apparatus according to claim 5, wherein the controlling portion controls the moving portion so that the moving portion moves at least one of the rotating member and the guide member in the thickness direction of the sheet bundle to nip the sheet bundle or separate from the sheet bundle according to a position on the sheet bundle of a set binding area, and size of the set binding area.

7. The sheet processing apparatus according to claim 5, wherein the controlling portion controls the moving portion so that the moving portion moves at least one of the rotating member and the guide member in the thickness direction of the sheet bundle to nip the sheet bundle or separate from the sheet bundle according to a position on the sheet bundle of a set binding area, size of the binding area, and number of the set binding area.

8. The sheet processing apparatus according to claim 5, wherein the rotating member is supported rotatably by a support member, which is movable along one end of the sheet bundle.

9. An image forming apparatus comprising:

an image forming portion that forms an image on a sheet; and a sheet processing apparatus that forms asperity on a sheet bundle, which includes plural sheets on which the image is formed, so as to bind the sheet bundle, the sheet processing apparatus including:

a pair of rotating members, each having a concave and convex portions on the outer periphery, configured to nip the sheet bundle and rotate with the respective phases of the concave and convex portions aligned to mesh with each other to form the asperity on the sheet bundle;

a moving portion that moves at least one of the pair of the rotating members in a thickness direction of the sheet bundle; and a controlling portion configured to control the moving portion so that the moving portion moves at least one of the pair of rotating members in the thickness direction of the sheet bundle so as to nip the sheet bundle or separate from the sheet bundle during relative movement between the pair of rotating members and the sheet bundle to bind the sheet bundle.

10. The image forming apparatus according to claim 9, wherein the controlling portion controls the moving portion so that the moving portion moves at least one of the pair of the rotating members in the thickness direction of the sheet bundle to nip the sheet bundle or separate from the sheet bundle according to a position on the sheet bundle of a set binding area, and size of the set binding area.

11. The image forming apparatus according to claim 9, wherein the controlling portion controls the moving portion so that the moving portion moves at least one of the pair of the rotating members in the thickness direction of the sheet bundle to nip the sheet bundle or to separate from the sheet bundle according to a position on the sheet bundle of a set binding area, size of the sheet binding area, and number of the set binding area.

12. The image forming apparatus according to claim 9, wherein the pair of the rotating members is supported rotatably by a support member, which is movable along one end of the sheet bundle.

13. An image forming apparatus comprising:

an image forming portion that forms an image on a sheet; and a sheet processing apparatus that forms asperity on a sheet bundle, which includes plural sheets on which the image is formed, so as to bind the sheet bundle, the sheet processing apparatus including:

a rotating member having a concave and convex portions on the outer periphery;

a guide member, having a concave and convex portions meshed with the concave and convex portions of the rotating member which meshes with the concave and convex portions of the rotating member, configured to guide rotation of the rotating members with the respective phases of the concave and convex portions aligned to mesh with each other to form the asperity on the sheet bundle;

a moving portion that moves at least one of the rotating member and the guide member in a thickness direction of the sheet bundle; and a controlling portion configured to control the moving portion so that the moving portion moves at least one of the rotating member and the guide member in the thickness direction of the sheet bundle so as to nip the sheet bundle or separate from the sheet bundle during movement of the rotating member along the guide member to bind the sheet bundle.

14. The image forming apparatus according to claim 13, wherein the controlling portion controls the moving portion so that the moving portion moves at least one of the rotating member and the guide member in the thickness direction of the sheet bundle so as to nip the sheet bundle or separate from the sheet bundle according to a position on the sheet bundle of a set binding area, and size of the set binding area.

15. The image forming apparatus according to claim 13, wherein the controlling portion controls the moving portion so that the moving portion moves at least one of the rotating member and the guide member in the thickness direction of the sheet bundle, while the rotating member is rotating, to nip the sheet bundle or to release the sheet bundle according to binding position set to the optional position in the rotating direction of the pair of the rotating members, binding area set to be optional size, and number of the binding area set to be optional number.

16. The image forming apparatus according to claim 13, wherein the rotating member is supported rotatably by a support member, which is movable along one end of the sheet bundle.

* * * * *